US006554676B1

(12) United States Patent
Bach

(10) Patent No.: US 6,554,676 B1
(45) Date of Patent: Apr. 29, 2003

(54) TOY BUILDING SET

(75) Inventor: Erik Bach, Billund (DK)

(73) Assignee: Interlego AG, Baar (CH)

( * ) Notice: Subject to any disclaimer, the term of this patent is extended or adjusted under 35 U.S.C. 154(b) by 0 days.

(21) Appl. No.: 10/070,045

(22) PCT Filed: Aug. 25, 2000

(86) PCT No.: PCT/DK00/00470

§ 371 (c)(1),
(2), (4) Date: Jun. 4, 2002

(87) PCT Pub. No.: WO01/15791

PCT Pub. Date: Mar. 8, 2001

(30) Foreign Application Priority Data

Aug. 27, 1999 (DK) ..... 1999 01191

(51) Int. Cl.[7] ..... A63H 33/08
(52) U.S. Cl. ..... 446/116; 446/124
(58) Field of Search ..... 446/124, 125, 446/126, 127, 128, 116, 117, 85

(56) References Cited

U.S. PATENT DOCUMENTS 3,005,282 A 10/1961 Christiansen
4,919,635 A 4/1990 Bertrand
5,471,808 A * 12/1995 De Pieri et al. ..... 446/128
5,795,210 A 8/1998 Kushner et al.
5,848,927 A * 12/1998 Frederiksen ..... 446/124

FOREIGN PATENT DOCUMENTS

| | | |
|---|---|---|
| GB | 1 269 755 | 4/1972 |
| GB | 2 136 700 | 9/1984 |
| NL | 8 101 580 | 10/1982 |

* cited by examiner

*Primary Examiner*—Jacob K. Ackun
(74) *Attorney, Agent, or Firm*—Pitney, Hardin, Kipp & Szuch LLP

(57) ABSTRACT

A toy building set of building elements (10, 30) having coupling studs (15) and cavities (34) to receive coupling studs (15) in frictional engagement. The cavity (34) accommodates guide means (37) which are adapted to contact coupling studs (15) with a lower friction, and which thereby preferably have a guiding function. This ensures that small and large toy building elements may be built together with a desired coupling force and with a desired friction.

2 Claims, 3 Drawing Sheets

TOY BUILDING SET

The present invention relates to a toy building set with toy building elements which have coupling studs and corresponding cavities to receive coupling studs on other building elements in frictional engagement.

GB 1 269 755 discloses a toy building set of the present type. In the cavities of the building elements there are two resilient walls or tongues in parallel with two outer walls. Cylindrical coupling studs on another building element can be received in the cavity such that they are in frictional contact with an outer wall as well as one of the resilient walls in the cavity. Projecting guide ribs are provided on the inner sides of the outer walls to ensure that coupling studs assume specific positions in the cavity.

U.S. Pat. No. 5,795,210 (see FIGS. 11 and 12) discloses building elements where the user, by orienting two building elements differently relative to each other, can choose to engage or disengage supplementary coupling means and thereby deliberately choose a "normal" coupling force or an increased coupling force between interconnected building elements.

These documents do not disclose coupling means with different friction against coupling means like in the present invention.

U.S. Pat. No. 3,005,282 discloses toy building sets with building elements, which are marketed under the trademarks LEGO and DUPLO.

FIGS. 1 and 2 show such a known toy building set 10 seen in perspective from above and from below, respectively. This known toy building element has a square horizontal cross-section with four vertical, outer walls 11 and a horizontal upper wall 12 which, together with the outer walls, defines a cavity 13 which accommodates a central tube 14 extending from the inner side of the upper wall. The upper side has four cylindrical coupling studs 15 which, as described in the above-mentioned U.S. Pat. No. 3,005,282, may be received in the cavity 13 of a corresponding building element so that that the coupling studs 15 are in frictional contact with the inner sides of the outer walls 11 and with the tube 14, which is also called a coupling tube.

FIG. 3 shows another known toy building element 16 seen from below, where the upper side of the element has cylindrical building studs (not shown) arranged in four rows perpendicular to each other with four coupling studs in each row. This building element has four outer walls 17 and a square outer shape. The four walls define a cavity 18 in which there are partitions 19 that divide the cavity into four subcavities. Each of the four subcavities accommodates a cylindrical coupling tube 20, and a central coupling tube is provided in the centre where the partitions 19 meet. All these coupling tubes extend from the lower side of the upper wall 21 of the building element, which forms a termination or a ceiling of the cavity 18.

The known building elements like in FIG. 3 and corresponding, larger building elements may be built together in the same manner as the building element 10 in FIGS. 1 and 2. Coupling studs on one of the elements 16 are received in the cavity 18 of another element, so that coupling studs are in frictional contact with the inner sides of the outer walls 17 and/or with one or two of the tubes 20 in the cavity. The partitions 19 in the cavity 18 are thinner than the outer walls 17, which means that coupling studs will not be in frictional contact with the partitions.

Consequently, only the coupling studs which are in contact with the outer walls at their corners have full friction, i.e. the same total friction as is the case with building elements in FIGS. 1–2, while coupling studs which are spaced from the corners and coupling studs having no contact with outer walls each have a smaller total friction. The total friction is here the frictional force, which must be overcome to assemble or to disassemble two building elements, and this force is therefore also called the coupling force.

This is intended by the known building elements, which have an upper side with 4×4 or more coupling studs. If the cavities of these known building elements were not arranged as described, but so that all 4×4 coupling studs had full friction in the cavity, then the total coupling force would be correspondingly greater than with two elements like in FIGS. 1–2, and it would thereby take a correspondingly greater force both to assemble and to disassemble them. It would therefore be difficult for children to assemble and disassemble large building elements having many coupling studs. It is therefore intentional that the partitions are formed such that coupling studs will not be in contact with the partitions, so that coupling studs in only some positions have full coupling force, while coupling studs in other positions have a reduced coupling force. This provides the advantage that children can easily assemble and disassemble even large toy building elements with many coupling studs.

Still, the known building elements like in FIG. 3 have a drawback. FIG. 3 moreover schematically shows the known building element 10 in FIGS. 1 and 2 with its four coupling studs 15 received in the cavity in the other known, larger building element so that none of the four coupling studs 15 is in contact with the outer walls 17. The four coupling studs 15 are here in contact with the central coupling tube in the cavity, as this coupling stud is positioned coaxially with the coupling tube 14 in the element 10. It will be seen that the building element 10 can rotate about the coupling tube between limits determined by the engagement of the coupling studs with the thin partitions 19, which thus serve as end stops for the rotation. Therefore, the two building elements thus built together are not fixed, but can rotate relatively to each other. Correspondingly, building elements with one, two or three coupling studs, all of which are in contact with the outer side of one and the same coupling tube, will be able to rotate.

The object of the invention is to remedy this drawback, or in other words to provide a toy building set where relatively large building elements may be built together in such a manner that the coupling force is essentially the same as for the known relatively large building elements, while a smaller building element is essentially fixed so that it cannot rotate when it is built together with a larger element.

This object is achieved by a building set according to the invention where guide means are arranged in the cavity, which restrict the movability of the coupling studs in the cavity, and which just have an insignificant friction against the coupling studs.

The invention will be described below by means of a preferred embodiment and with reference to the drawings, in which FIG. 1 shows a known toy building element seen in perspective from above.

Figure 1:
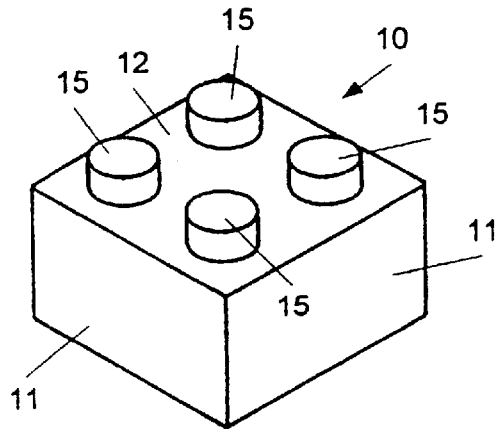
Fig. 1 PRIOR ART
Figure 2:
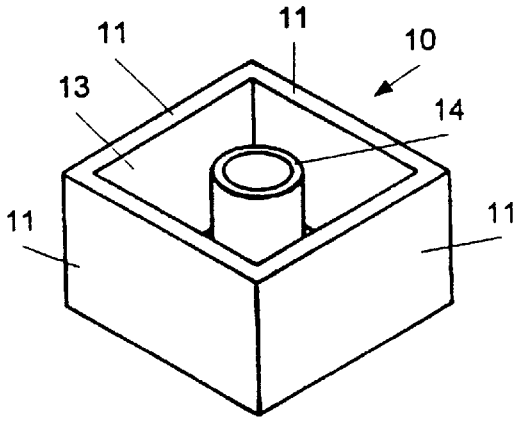
Fig. 2 PRIOR ART
FIG. 2 shows the known toy building element of FIG. 1 seen in perspective from below.
Figure 3:
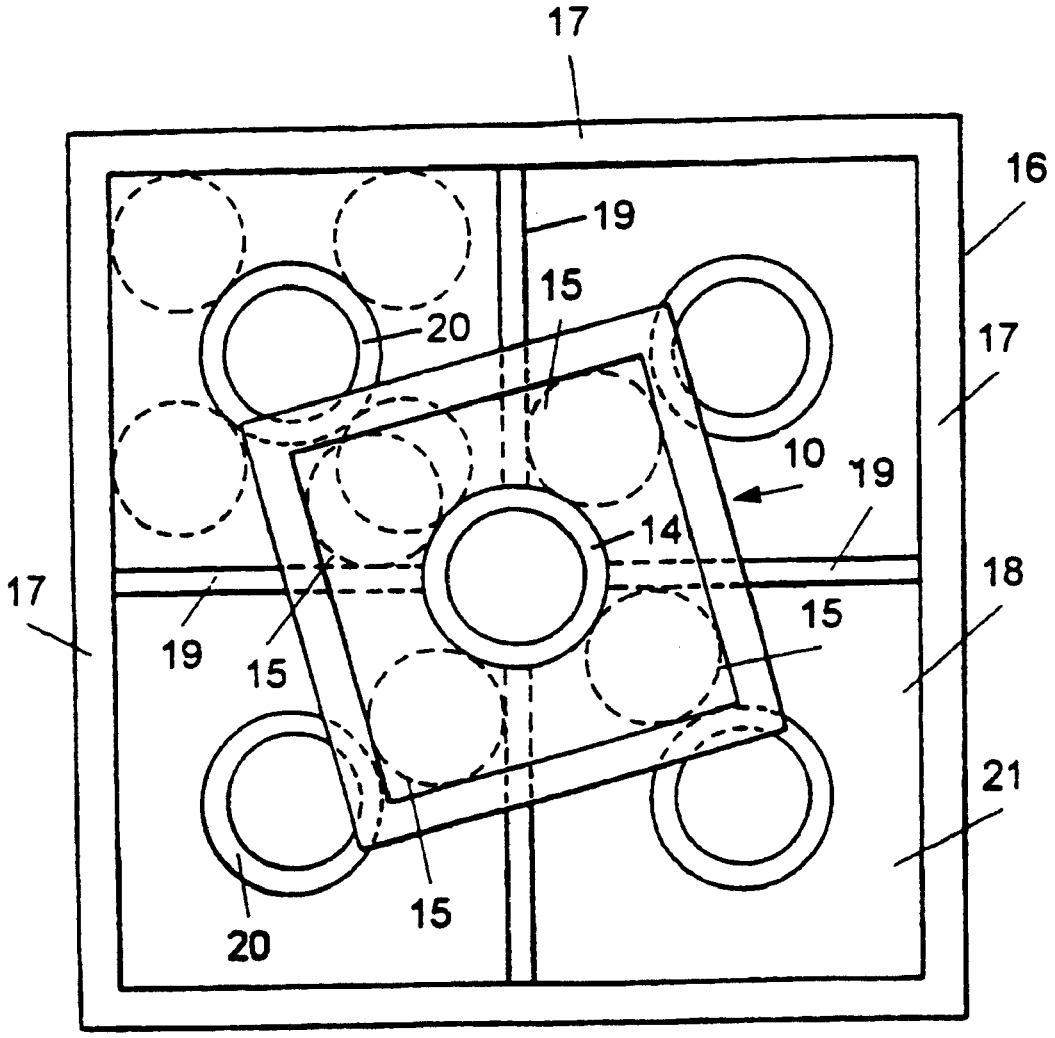
Fig. 3 PRIOR ART
FIG. 3 shows the known toy building element of FIGS. 1 and 2 built together with another known toy building element, seen from below.

FIGS. 1–3 thus show the prior art, which is described above.

Figure 4:
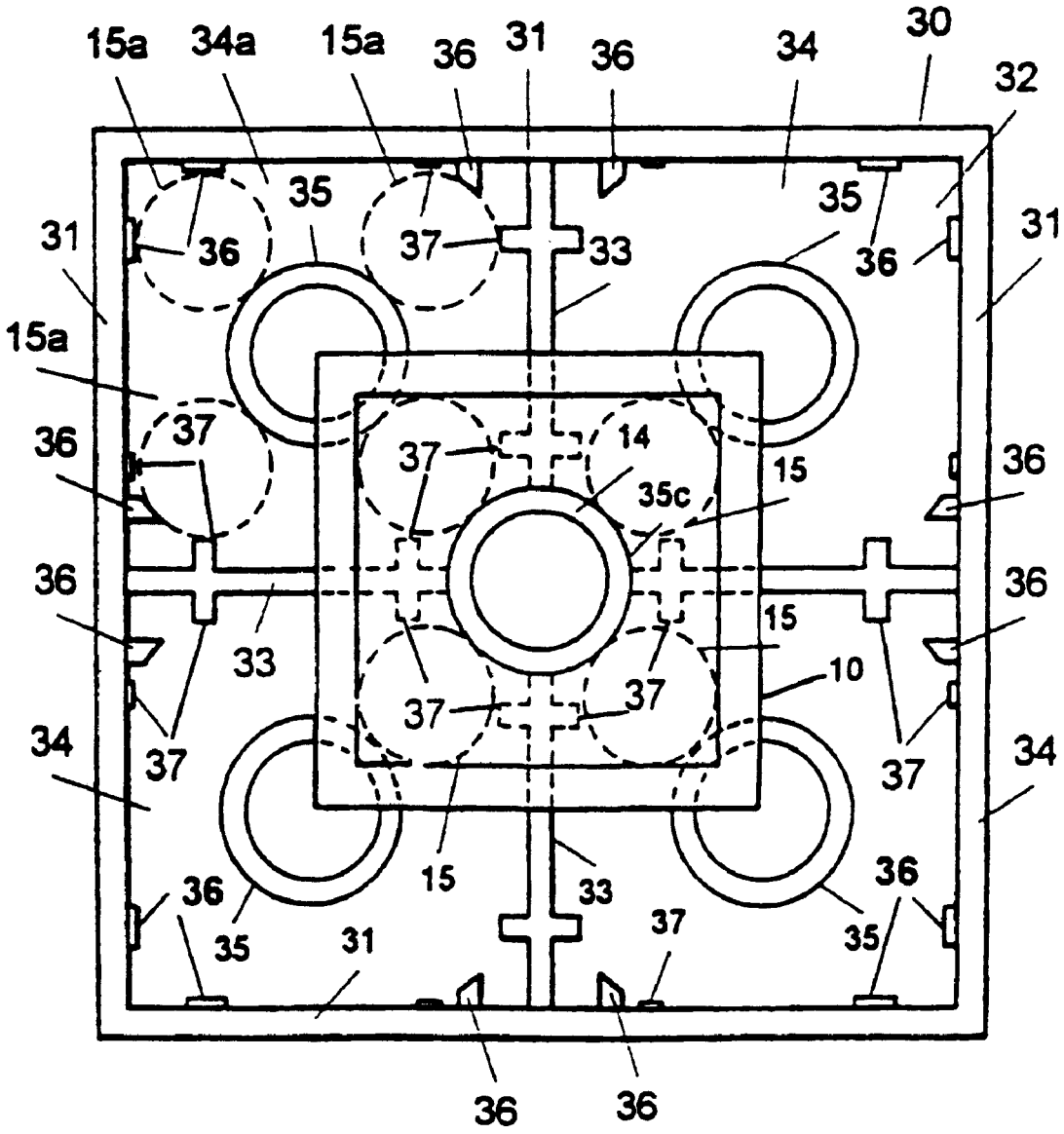
FIG. 4 shows a toy building element according to the invention built together with the known toy building element of FIGS. 1 and 2, seen from below.

FIG. 4 shows a toy building element 30 having four outer walls 31 which define a cavity 32. The cavity 32 has internal partitions 33 which divide the cavity 32 into four smaller subcavities 34, 34*a* in the same manner as in the building element 16 in FIG. 3. Each of the four subcavities 34 accommodates a coupling tube 35 positioned centrally in the respective subcavities. The known building element 10 is built together with the building element 30, where each of the coupling studs 15 on the element 10, in the same manner as in FIG. 3, is in contact with its respective one of the coupling tubes 35 and with a central coupling tube 35*c* which is coaxial with the coupling tube 14. Possible positions for coupling studs 15*a* on a building element are shown in the subcavity 34*a*. In all possible positions for coupling studs, the coupling studs are in frictional contact with one or two coupling tubes 35, 35*c*, which contributes to the coupling force between the building elements 10 and 30 built together.

The outer walls 31 and the partitions 33 have projecting ribs with two different functions, which will be explained below.

The outer walls 31 are here slightly thinner than the corresponding outer walls 11 and 17 on the building element 10 and 16, respectively, in FIGS. 1–3. A first advantage of this is that some material is saved. To achieve coupling force between coupling studs 15, 15*a* and the outer walls 31, the outer walls are provided with projecting coupling ribs 36 at selected places, said coupling ribs being arranged such that when a building element 10 is built together with the building element 30, coupling studs on the building element 10 will be in frictional contact either with the coupling tubes 35, 35*c* or with coupling ribs 36 or a combination thereof.

Another advantage of the thinner outer walls is that the coupling ribs 36 may be arranged in selected positions on the walls where it is expedient to have coupling force. It will be seen that in comparison with the building elements in FIG. 3, it is just in one half of the possible positions for coupling studs on the building element 30 that the coupling studs will contact a coupling rib 36. If a greater coupling force is desired, the number of coupling ribs 36 may be increased, and if a smaller coupling force is desired, the number of coupling ribs 36 may be reduced.

The coupling ribs 36 are here arranged in positions in which their contact faces for contact with coupling studs are positioned in pairs diametrically opposite each other relative to a coupling tube 35. The contact faces have an orientation, which is tangent to the coupling studs and provides face contact with a final contact area and not just point or line contact. In some positions, a coupling stud will thus couple at two places on its cylindrical surface, while in other positions a coupling stud will just couple at a single place on its cylindrical surface. This configuration, where the individual coupling stud just couples at one or two places on its cylindrical surface, is not sufficient per se to ensure a well-defined mutual position of the two building elements 10 and 30.

The outer walls 31 and the partitions 33 therefore additionally have guide ribs 37 which will contact a coupling stud with a frictional force which is insignificant or at least considerably smaller than the coupling force between a coupling stud and a coupling tube or a coupling rib. The guide ribs 37 are arranged in selected positions relative to the coupling studs 15, 15*a* so as to ensure that preferably (but not necessarily) all coupling studs can only assume a well-defined position without any possibility of being displaced laterally. This is ensured in that in such positions the sum of the number of coupling tubes, coupling ribs and guide ribs is at least three, these three defining a triangle or another polygon, which circumscribes the centre of the coupling, stud.

All the guide ribs 37 are shown here with a rectangular cross-section, and for clarity they are shown schematically so that there is a small gap between guide ribs and coupling studs. To achieve precise positioning of coupling studs, it is best in theory of course to have as small a gap as possible, but the gap may be given a size which allows just as great or small a movement as can be accepted.

By suitable dimensioning of the guide ribs 37, they may also contribute to the coupling force between interconnected elements, if desired. In that case, the gap will disappear of course.

Clearly, coupling tubes, coupling ribs and guide ribs or combinations thereof, define the position of the coupling studs, and in some coupling positions the coupling force can thus be higher or lower than in others.

The term "guide ribs" is selected here as a designation of the means which essentially just have a guiding function and thus essentially just contribute to defining the position of the coupling studs, and which contribute to the coupling force between interconnected elements to a less or insignificant degree. The terms "coupling tubes" and "coupling ribs" are correspondingly used about the means which essentially contribute to the coupling force between interconnected elements, even though they necessarily also contribute to defining the position of the coupling studs.

What is claimed is:

1. A toy building set comprising a first toy building element (10) having a side wall with four cylindrical coupling studs (15) arranged with their axes defining respective corners of a first square, and a second toy building element (30) having walls (31) which define a cavity (32) with four tubular coupling means (35) arranged with their axes defining respective corners of a second square, and one tubular coupling means (35) arranged with its axis in the centre of the second square, wherein each tubular coupling means (35) is capable of fitting in between the four cylindrical coupling studs (15) of the first toy building element (10), and the four cylindrical coupling studs (15) of the first toy building element (10) are capable of fitting in between the four tubular coupling means (35) of the second toy building element (30) so that each of the four cylindrical coupling studs (15) is in contact, with a first friction, both with a respective one of the four tubular coupling means (35) of the second square and with the tubular coupling means (35) in the centre of the second square, wherein the second toy building element (30) has, in the cavity (32), partitions (33) with guide means (37) restricting the lateral movement of the coupling studs (15) fitted between two tubular coupling means (35).

2. A toy building set according to claim 1, wherein the guide means (37) are adapted to contact coupling studs (15) with a second friction, which is smaller than the first friction.

* * * * *